US006659682B2

(12) United States Patent
Heeks

(10) Patent No.: US 6,659,682 B2
(45) Date of Patent: Dec. 9, 2003

(54) DEFORMABLE SPEED HUMP

(75) Inventor: Graham Heeks, Cheshire (GB)

(73) Assignee: Autospan Limited, Manchester (GB)

( * ) Notice: Subject to any disclaimer, the term of this patent is extended or adjusted under 35 U.S.C. 154(b) by 0 days.

(21) Appl. No.: 09/990,409

(22) Filed: Nov. 21, 2001

(65) Prior Publication Data

US 2002/0085881 A1 Jul. 4, 2002

Related U.S. Application Data

(63) Continuation-in-part of application No. 09/180,621, filed as application No. PCT/GB98/00748 on Mar. 12, 1998, now abandoned.

(30) Foreign Application Priority Data

Mar. 12, 1997 (GB) ..... 9705078

(51) Int. Cl.[7] ..... E01F 11/00
(52) U.S. Cl. ..... 404/15
(58) Field of Search ..... 404/6, 10, 11, 404/15, 16

(56) References Cited

U.S. PATENT DOCUMENTS

| | | | | | |
|---|---|---|---|---|---|
| 3,720,181 | A | * | 3/1973 | Elkins | 116/63 P |
| 4,203,685 | A | * | 5/1980 | Sanchez | 404/6 |
| 4,362,424 | A | * | 12/1982 | Barber | 293/107 |
| 4,367,975 | A | * | 1/1983 | Tyers | 404/11 |
| 4,534,673 | A | * | 8/1985 | May | 404/14 |
| 5,415,493 | A | * | 5/1995 | Eaton | 404/15 |
| 5,419,652 | A | * | 5/1995 | Flanders | 14/69.5 |
| 6,010,277 | A | | 1/2000 | Follman | 404/11 |
| 6,024,510 | A | | 2/2000 | Kamienchick | 404/15 |
| 6,276,667 | B1 | * | 8/2001 | Arthur | 256/13.1 |

FOREIGN PATENT DOCUMENTS

| | | | | |
|---|---|---|---|---|
| DE | 2914-708 | * | 10/1980 | 404/6 |
| DE | 3447712 A1 | | 8/1986 | |
| EP | 370154 | * | 5/1990 | E01F/9/04 |
| FR | 2622034 | * | 4/1989 | G08G/1/10 |
| FR | 2699567 | * | 6/1994 | E01F/11/00 |
| GB | 2266552 A | | 11/1993 | |
| GB | 2288419 | * | 10/1995 | E01F/9/047 |
| GB | 2328235 A | | 2/1999 | |
| GB | 2328235 | * | 2/1999 | E01F/9/047 |
| KR | 0020924 | * | 4/2000 | E01F/9/047 |
| WO | WO 93/24707 | | 12/1993 | |
| WO | WO 01/63051 | | 8/2001 | |

* cited by examiner

*Primary Examiner*—Gary S. Hartmann
*Assistant Examiner*—Kristine Florio
(74) *Attorney, Agent, or Firm*—Woodcock Washburn LLP

(57) ABSTRACT

A road traffic speed control device which is located in a roadway, is formed of resiliently deformable material and is deflatable by the passage of a vehicle thereover at the intended speed limit of the vehicle in the roadway, in use. The device may be formed from an extruded or compressed partially recyclable rubber compound.

16 Claims, 4 Drawing Sheets

DEFORMABLE SPEED HUMP

This is a continuation-in-part of U.S. patent application Ser. No. 09/180,621, filed Jan. 8, 1999, which was the National Stage of International Application Ser. No. PCT/GB98/00748, filed Mar. 12, 1998, which claims priority to Great Britain Application No. 9705078.5 filed Mar. 12, 1997. The present application is related to U.S. patent application Ser. No. 10/204,895, filed Aug. 26, 2002.

Speed humps or 'Sleeping Policeman, ' as they are better known, are well known deterrents for speeding motorists and are becoming more widely used through the traffic calming measures being imposed by local authorities. The present speed hump can be either an asphalt or block paviour mound, which are formed directly upon the existing road surface or as an alternative can be made from a solid compound such as plastic which again can be fitted to the road surface.

According to the authorities and surveys of public opinion it is essential to reduce the speed of motorist in general especially on inner city urban carriage ways. The present systems of speed control are costly and disruptive, with the tax payer and local businesses bearing the cost. Additionally the confusion caused to an already congested road network is totally unacceptable with journey times increasing and repairs to the roads never ending.

It is an object of the present invention to obviate or mitigate the above problems. According to the invention there is provided a road traffic speed control device which is locatable in a roadway, is formed of a resiliently deformable material and is deflatable by the passage of a vehicle thereover at the intend-e-d speed limit of said vehicle in said roadway, in use.

The device may be formed from an extruded or compressed partially recyclable rubber compound.

The device may be generally semi-cylindrical or sinusoidal in transverse cross-section and may be formed with perforations or apertures therein to permit deflation.

Alternatively or in addition, valve means may be located in a side wall of the device to allow deflation and reinflation, in use.

One or more helical springs, which may be encased in a split sleeve, may be located within the device to assist in shape retention.

The device may be formed with perforations, apertures or valve means to provide deflation thereof with passage thereover of a vehicle traveling from a minimum speed of 5 mph through increments to a required maximum.

The device may be formed such that subsequent to deflation by the front wheels of a vehicle passing thereover, reinflation may be delayed to allow the rear wheels to pass thereover during such initial deflation.

The foregoing and further features of the invention may be more readily understood from the following description of preferred embodiments thereof, by way of example with reference to the accompanying drawings in which.

Figure 1:
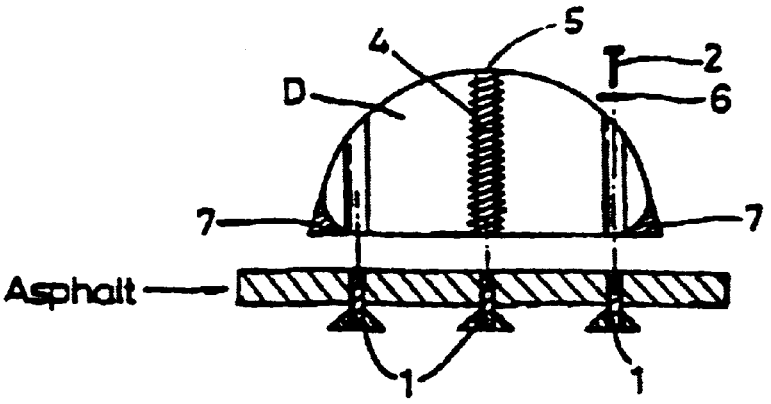
FIG. 1 shows a schematic end sectional view of a road traffic speed control device and fixing therefore.
Figure 2:
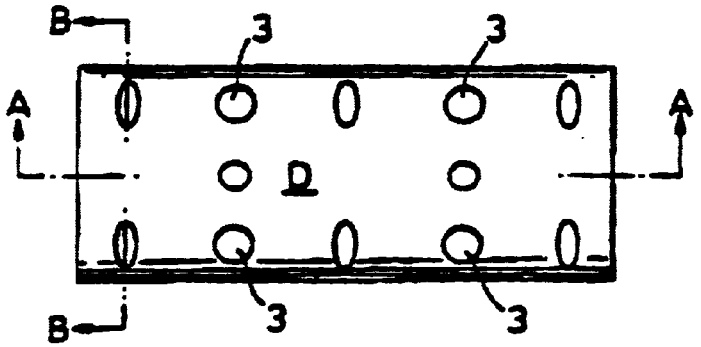
FIG. 2 shows a plan view of the device of FIG. 1.
Figure 2A:
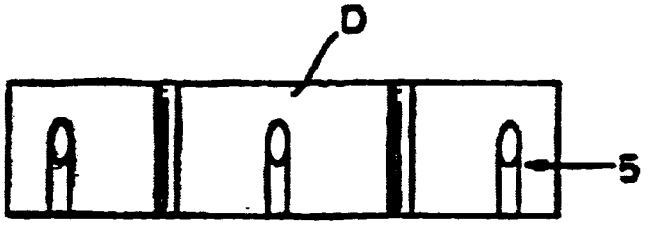
FIGS. 2A and 2B show sectional views along the lines A—A and B—B respectively of FIG. 2.
Figure 2B:
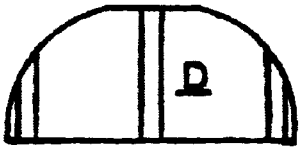

Referring now to the drawings a road traffic speed control device D is preferably formed from an extruded or compressed recyclable rubber compound. The shape represents a semi-cylindrical, sectional shape in construction with a series of apertures 3 formed through the profiled casing, which allows the circulation of air under controlled circumstances to be released, thus deflating the device D into a level plane giving a smooth passage to a vehicle passing thereover.

To assist in the shape retention a helical spring 4 encased in a suitable split sleeve 5 is installed at the center of the device D. To secure the unit a spreader plate or washer 6 is inserted at the base of the protective shroud during the curing procedure to help relieve the impact force when in operation. Also to assist in the distribution of the impact forces, the device D is tapered into a fillet 7 at each end of the base line thereof.

The device D is preferably produced in 750 mm. sections accompanied by tailor made inserts 8 to complete a road crossing (determined during the on site survey). To assist in the equal spacing of the device D a 50 mm spacer 9 is molded onto the end of the unit which is interlocked at 10 to provide an overall 05 mm. expansion gap giving added rigidity to the whole structure.

The device D is attached to a road surface by bolts 2 engaging into anchoring devices 1 located in the road surface.

The idea profile is 750 mm in width and 100 mm in height. This is uniform throughout the entire structure which enables vehicle manufacturers to work to a stated height restriction from the top of the hump to the underside of the vehicle similar to the restriction placed on high sided vehicles. Should damage occur, the section in question can be simply unbolted and replaced by a standard length of device causing minimal disruption and with no road excavation taking place.

The number and size of apertures 3 is determined to allow the device D to be deflated by the front wheels of a vehicle passing thereover, providing the vehicle is not exceeding a predetermined speed.

Should the vehicle be traveling at a speed exceeding the predetermined maximum; the device does not deflate and acts substantially as a rigid hump.

Figure 3:
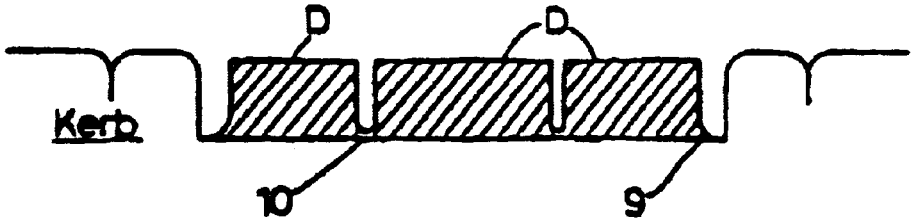
FIG. 3 is a schematic sectional view of devices of FIGS. 1 and 2 located across a road.
Figure 4:
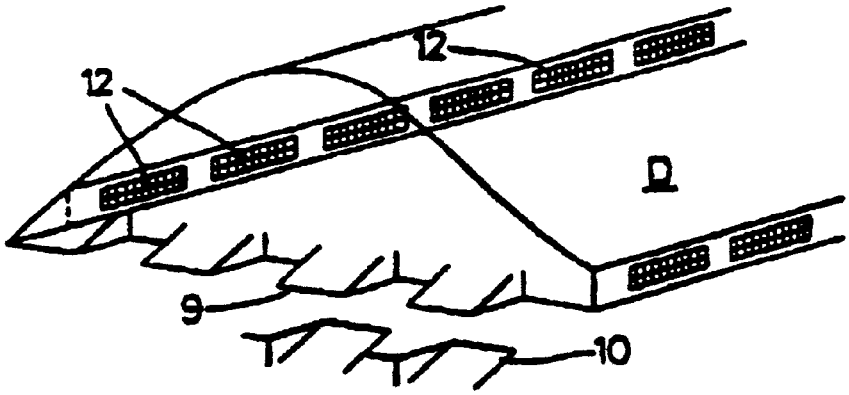
FIG. 4 is a schematic perspective view of a device showing drainage to discharge surface water.

FIG. 3 shows a device D with drainage apertures 12 covered with mesh to prevent the ingress of leaves or other debris into device D.

Figure 5:
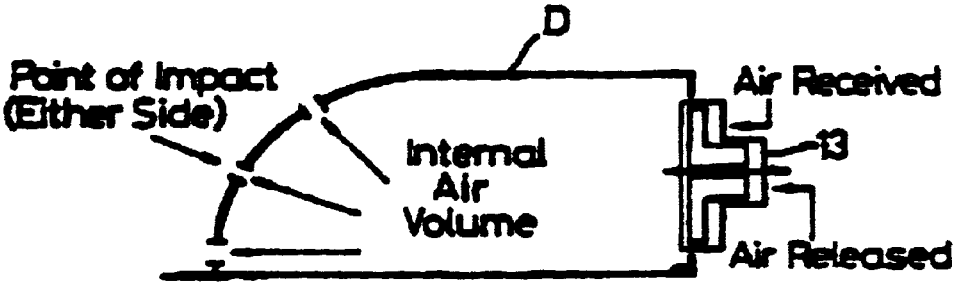
FIG. 5 is a schematic end sectional view of an alternative device including a two-way valve for controlling deflation and reinflation, in use.

FIG. 5 shows an alternative device D having a two-way valve 13 provided to control deflation and reinflation and may be adjustable to control maximum speed at which deflation does not occur. Such valve 13 may be provided in addition to apertures 3 or as on alternative thereto.

Figure 6:
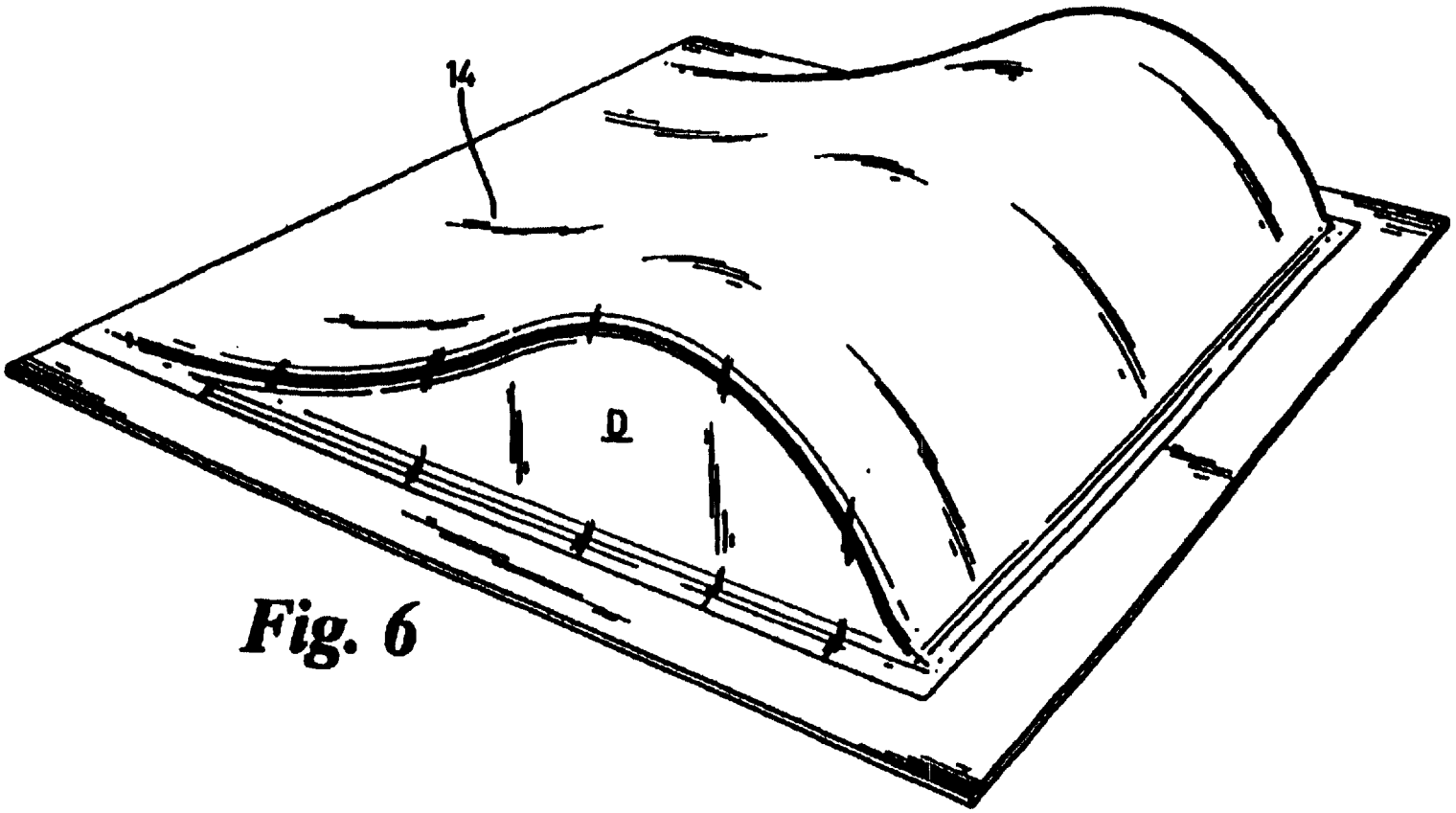
FIG. 6 is a perspective view from above of a further alternative embodiment.
Figure 7:
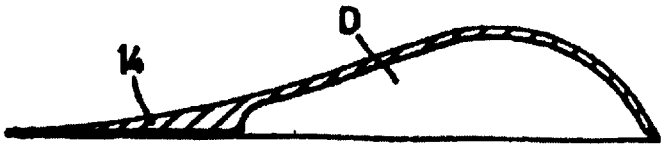
FIG. 7 is a schematic side sectional view of the embodiment of FIG. 6.

FIGS. 6 and 7 show a further alternative embodiment in which the cross section of the device is generally sinusoidal so as to provide a relatively smooth passage over a solid run up portion 14 of the device prior to a vehicle traversing the deflatable portion D.

Figure 8:
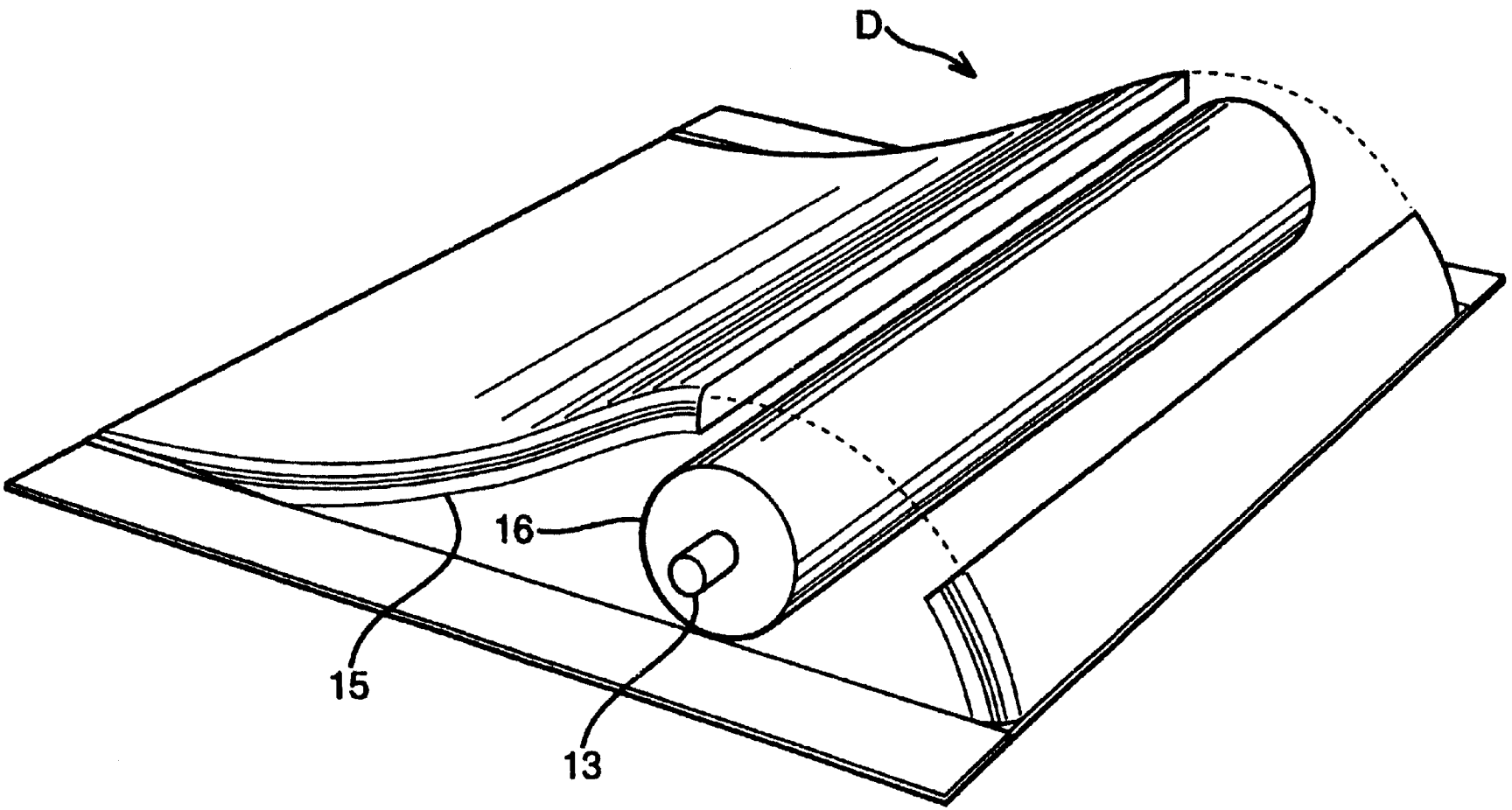
FIG. 8 shows a perspective view of a further embodiment of the invention.

A further embodiment of the invention is shown in FIG. 8. This has an outer, vehicle bearing wall and an inner tube 16 located inside the cavity of the device D, mounted transversely in relation to the roadway. The valve means 13 are connected directly to the inner tube 16. As with other embodiments, the air passes freely to the atmosphere under the dictates of the valve 13 but now the inner tube provides a more predictable air volume. This therefore allows better control of the speed response of the device. The inner tube 16 is made resilient such that after passage of the vehicle, the inner tube retains its shape, therefore refilling with air through the valve 13. The outer wall 15 of the device may itself be resilient or may re-assume its shape due to the resilience of the inner tube. Consequently a more predictable operation of the valve 13 is obtained. The part of the cavity outside the hose may be sealed or open to the atmosphere without restriction.

What is claimed is:

1. A road-traffic speed-control device which is locatable in a roadway, said device comprising a speed hump formed from a resiliently-deformable material and having at least one of a perforation, an aperture and a valve means disposed therein so that air within said device is in restricted communication with a surrounding atmosphere to permit deflation of said device by a passage of a vehicle over said device at an intended speed limit of said vehicle in said roadway, but not at speeds exceeding said speed limit, and is sufficiently resilient to reinflate itself automatically after passage of said vehicle.

2. The road traffic speed control device recited in claim 1, wherein said resiliently-deformable material is an extruded partially-recyclable rubber compound.

3. The road traffic speed control device recited in claim 1, wherein said resiliently-deformable material is a compressed partially-recyclable rubber compound.

4. The road traffic speed control device recited in claim 1, wherein said device has a semi-cylindrical cross-section.

5. The road traffic speed control device recited in claim 1, wherein said device has a substantially sinusoidal cross-section.

6. The road traffic speed control device recited in claim 1, wherein said device reinflates after said deflation, said device further comprises a valve which permits said deflation and reinflation, and said valve is disposed in a side wall of said device.

7. The road traffic speed control device recited in claim 1, further comprising a helical spring disposed within said device, said spring biasing said device in an inflated position.

8. The road traffic speed control device recited in claim 1, wherein said device is deflated by said passage of a vehicle over said device at a speed of between 5 mph and said intended speed limit of said vehicle in said roadway.

9. The road traffic speed control device recited in claim 1 comprising inner and outer walls of resiliently deformable material, the inner wall defining an elongate chamber for having said restricted communication with the atmosphere, the outer wall providing a surface for vehicles.

10. The road traffic speed control device recited in claim 9, wherein said inner wall comprises a substantially cylindrical tube extending within the device, while the outer wall defines a part-sinusoidal profile.

11. The road traffic speed control device recited in claim 9, wherein air in a space between said inner and outer walls is not in communication with the surrounding atmosphere.

12. The road-traffic speed-control device of claim 1, wherein the speed hump is sufficiently resilient to reinflate itself automatically after passage of said vehicle by drawing air from the atmosphere through the at least one of a perforation, an aperture and a valve means.

13. A road-traffic speed-control device locatable on a roadway, comprising a resiliently-deformable speed hump having an interior portion for holding a fluid, and at least one of a perforation formed in the speed hump, an aperture formed in the speed hump, and a valve mounted on the speed hump, wherein:

the at least one of a perforation, an aperture, and a valve permits the fluid to flow out of the interior portion when a pressure of the fluid is below a predetermined value corresponding to a pressure of the fluid when a vehicle passes over the speed hump at a predetermined speed, so that the speed hump deflates when the vehicle passes over the speed hump at a speed below the predetermined speed; and the at least one of a perforation, an aperture, and a valve prevents the fluid from flowing out of the interior portion when a pressure of the fluid is approximately equal to or greater than the predetermined value so that the speed hump does not deflate when the vehicle passes over the speed hump at a speed approximately equal to or above the predetermined speed.

14. The road-traffic speed-control device of claim 13, wherein the at least one of a perforation, an aperture, and a valve permits the fluid to flow into the speed hump so that the speed hump self-inflates after the vehicle has passed over the speed hump at the speed below the predetermined speed.

15. A road-traffic speed-control device locatable on a roadway, comprising a speed hump resiliently deformable between an inflated state and a deformed state, and at least one of a perforation formed in the speed hump, an aperture formed in the speed hump, and a valve mounted on the speed hump, wherein:

the at least one of a perforation, an aperture, and a valve permits a fluid located inside the speed hump to pass through the at least one of a perforation, an aperture, and a valve to an environment outside the speed hump when the speed hump is subject to an impact load below a predetermined level so that the speed hump deforms in response to the impact load below the predetermined level; and the at least one of a perforation, an aperture, and a valve prevents the fluid located inside the speed hump to pass through the at least one of a perforation, an aperture, and a valve when the speed hump is subject to an impact load approximately equal to or greater than the predetermined level so that the speed hump remains in the inflated state when subject to the impact load approximately equal to or greater than the predetermined value.

16. The road-traffic speed-control device of claim 15, wherein the valve permits a fluid located in the environment outside the speed hump to flow into the speed hump after the speed hump has been subject to the impact load below the predetermined value so that the speed hump returns to the inflated state.

* * * * *